United States Patent [19]

Jacob et al.

[11] Patent Number: 4,592,192

[45] Date of Patent: Jun. 3, 1986

[54] APPARATUS FOR THE PACKAGING OF CONTAMINATED WASTE MATERIALS

[75] Inventors: Manfred Jacob; Fritz Tews, both of Linkenheim-Hochstetten, Fed. Rep. of Germany

[73] Assignee: Gesellschaft fuer Nukleartechnik mbH, Linkenheim, Fed. Rep. of Germany

[21] Appl. No.: 514,270

[22] Filed: Jul. 15, 1983

[30] Foreign Application Priority Data

Aug. 21, 1982 [DE] Fed. Rep. of Germany ..... 3231221

[51] Int. Cl.[4] ..... B65B 31/02

[52] U.S. Cl. ..... 53/512; 53/298; 53/329; 252/626; 252/633

[58] Field of Search ..... 252/626, 633; 53/298, 53/510, 512, 526, 329; 250/517.1, 507.1, 506.1; 100/90, 91, 229 R, 229 A; 141/73, 80, 93; 156/580; 422/159, 903

[56] References Cited

U.S. PATENT DOCUMENTS

| | | | |
|---|---|---|---|
| 3,899,967 | 8/1975 | Powers | 100/295 |
| 3,996,725 | 12/1976 | Walles | 53/510 |
| 4,008,658 | 2/1977 | Stock et al. | 252/626 |
| 4,061,480 | 12/1977 | Frye et al. | 252/626 |
| 4,273,037 | 6/1981 | Ruebesam | 100/229 A |
| 4,282,699 | 8/1981 | Embro | 53/298 |
| 4,357,541 | 11/1982 | Ernst | 250/507.1 |

FOREIGN PATENT DOCUMENTS

| | | | |
|---|---|---|---|
| 2659691 | 11/1978 | Fed. Rep. of Germany | 252/626 |
| 1528478 | 10/1978 | United Kingdom | 252/626 |

*Primary Examiner*—Stephen J. Lechert, Jr.
*Assistant Examiner*—Howard J. Locker

[57] ABSTRACT

A method of and apparatus for packaging contaminated or poisonous waste materials. The waste materials are deposited in a plastic bag disposed on a cylindrical opening in a container provided with a lid and having vacuum and filter means for sucking air off the area of the open upper end of the plastic bag when the lid is opened for disposal of waste. Below the lid there is provided a plastic foil and means for moving the plastic foil over the bag opening for sealing the plastic bag by means of a heating structure which is adapted to engage and heat the plastic bag and foil. Before sealing of the bag, however, the vacuum means is energized with the lid closed so that the plastic bag is evacuated and, after sealing and opening of the container cover, may be removed in a compressed, easily manageable state with relatively small volume.

10 Claims, 2 Drawing Figures

APPARATUS FOR THE PACKAGING OF CONTAMINATED WASTE MATERIALS

FIELD OF THE INVENTION

The invention relates to a method and apparatus for the packaging of contaminated waste materials, especially radioactive waste materials, into plastic bags which can be handled manually and which, in order to be filled, are fitted into a waste container. After being filled the plastic bags are tightly closed in a suitable manner.

BACKGROUND OF THE INVENTION

In medicine and ecology the expression "contamination" generally relates to the contamination of food, objects and areas as well as air, water and soil by microorganisms, industrial discharge, exhaust gases and radioactive materials. Contamination by microorganisms, industrial discharge and exhaust gases has been known and has been the object of research for some time already. In many instances, countermeasures have already been found and equipment for preventing such contamination has been developed. Contamination by radioactive materials however has been occurring only more recently and has been observed at an increased rate as radioactive materials find increasing use in industry as well as in medicine. In the past, for example, open waste baskets with foot-operable lids into which paper or plastic bags were inserted for the reception of contaminated materials were considered sufficient. However, especially for disposal of radioactive materials, such equipment is no longer acceptable. Radioactive materials can be present as floating small particles or aerosols thereby spreading their effectiveness over a large area. With the radioactive particles, dangerous radiation may also be widely spread. The radiation emitted by such radioactive materials is usually $\alpha$, $\beta$ and $\gamma$ radiation. Alpha and Beta radiation may be shielded effectively in a relatively simple manner or at least may be weakened to such a degree that there is no serious danger for people. Gamma radiation, however, requires special provisions in order to keep exposure of people as low as possible.

With this precaution in view, present provisions and apparatus for the storing and discarding of industrial chemical waste materials are not adequate for the storing and discarding of exposed radioactive waste materials. Weak radioactive waste materials are mainly generated by the use of radioactive materials in medicine, in medical and biological research and during other scientific research projects. Such waste materials comprise usually solid waste such as containers, test tubes, pipettes, etc., and liquid waste materials such as solvents, dead bodies, waste water and the like. A substantial portion of such waste materials resides in decomposable materials such as contaminated bodies of test animals or soaked bandage materials.

According to presently valid radiation protection rules, radioactive waste materials must be delivered for disposal to officially admitted installations. Before delivery however the waste materials are collected, packaged and stored by the waste generator until they are shipped. If the radioactive materials have only short half lives, the radioactivity of the radioactive materials will diminish during such provisional storage to such a degree that the waste materials may no longer be considered to be radioactively contaminated. In any case, however, the radioactive materials must first be placed into sealed plastic bags to contain radioactive materials and to prevent escape of microorganisms (bacteria and viruses) as well as floating radioactive particles and aerosols.

Present handling practices for contaminated materials are without adequate precautions. A relatively large part of generators of contaminated materials are still using lid-covered baskets into which plastic bags are inserted which, when filled, are simply closed at the top and maintained closed by twist-ties.

It is pointed out that plastic bags, when placed into baskets, are fully opened at their top end for the reception of waste material so that microorganism or other floating parts and aerosols may easily escape whenever the basket lid is opened. There is also the danger of radiation exposure if unconsolidated radioactive waste materials are deposited in the plastic bag. Especially great is the chance of contamination when the plastic bag is closed by a worker since, during this process, air is forced out of the plastic bag, which air may carry a substantial amount of contaminated floating particles or microorganisms toward the worker. Under these circumstances, there is not only a danger of surface contamination but contaminated particles are likely to be inhaled.

It is an object of the present invention to prevent contamination of handling personnel. It is pointed out that contaminated waste materials are deposited in interim storage facilities and are retained there until their radioactivity is subsiding. Such interim storage requires specially adapted chambers with relatively expensive equipment and shielding. The interim storage should therefore require only minimum space. In accordance with prior art practice, however, the plastic bags contain, in volume, about 80% air such that these expensive storage chambers actually contain, when filled, only 20% contaminated waste materials.

It is therefore another object of the present invention to package the waste material for only a minimum volume, that is, to avoid air enclosure in the plastic bags containing the waste materials.

In the prior art, such waste materials are also known to be filled directly into 200 l. barrels which are closed automatically without the presence of a person. In this case, no person is subjected to contamination but a relatively large amount of air is still enclosed in these barrels. Therefore, the waste materials are sometimes shredded or compacted by a compactor so as to reduce volume. However, such equipment is voluminous and therefore cannot be used in laboratories so that the contaminated materials need first to be disposed in smaller bags which then are collected and brought to a shredder or compactor. However, the smaller bags are handled manually, causing the very problem described before, before they arrive at the site equipped for automatic disposal.

SUMMARY OF THE INVENTION

The problems associated with the disposal of contaminated materials are alleviated by a method of, and apparatus for, packaging contaminated or poisonous waste materials in a plastic bag which is disposed in a cylindrical opening in a container including vacuum and filter means for sucking air from the area around the opening of the plastic bag when waste materials are deposited in the plastic bag so as to prevent the escape of contaminated or poisonous particles from the plastic bag. The vacuum means is connected to an absolute filter also disposed in the container so as to retain any particles carried in the air discharged by the vacuum means. The container receives a roll of plastic foil and is provided with a mechanism for moving a section of the plastic foil above the plastic bag opening when the plastic bag is filled and the waste material is to be sealed in. Means are provided for engaging the plastic bag rim with the plastic foil and heating the engaged portions of the plastic bag and plastic foil for welding them together. At the same time, the vacuum means is energized with the container lid closed so that the plastic bag is evacuated and, upon completion of the seal, compressed by the atmospheric pressure when, for removal of the plastic bag, air under atmospheric pressure is admitted to the container. The plastic bag, compressed to substantially reduced volume, is then easily removable from the container and requires only relatively small storage space.

Plastic bags are still being used as packaging materials. The plastic bags of up to 30 l. volume are handy in size especially since, with the method according to the present invention, the plastic bags are no longer tightly filled and relatively bulky but of much reduced volume since air representing normally about 80% of the volume is removed. They can therefore be handled very easily and with much reduced danger of being pierced during handling.

In an arrangement for performing the method according to the present invention a container encloses a cylinder which is closed at its bottom and has a size so as to receive a plastic bag. The cylinder is mounted in an airtight manner into the top plate of the container which surrounds the cylinder. The cover plate has an opening with a pivotal lid above the cylinder opening. The cover plate has a suction duct incorporated therein which duct is in communication with a vacuum pump disposed in the housing and having its discharge connected to an absolute filter. The cover plate includes a chamber for the reception of a cover foil and a mechanism for sliding the cover foil over the plastic bag opening. The rim of the cylinder has a heating ring axially movably supported thereon and the cover is provided with a matching abutment surface to permit welding of the cover foil to the plastic bag. Electric control means are provided on the housing for controlling energization of the vacuum pump and of the heating ring for the welding process. If the plastic bag itself is weldable, it may be directly closed by welding without the use of a cover foil. The arrangement according to the invention is such that the electric controls automatically energize the pump motor when the waste container lid is opened so that the air above the container opening is sucked away and pumped through the absolute filter so that waste materials already deposited in the plastic bag in the waste container cannot cause contamination of operating personnel. In addition, the plastic bag, after being filled with waste materials, is automatically evacuated and sealed airtight whereupon it may be removed from the container and shipped to provisional storage facilities or to final disposal facilities without the risk of contamination for the operating personnel. After insertion of a new plastic bag the apparatus is again ready for further use.

In order to permit the detection of leakage of the plastic bag, a humidity sensor may be so disposed at the bottom of the container that it indicates humidity accumulated there. If this happens, the plastic bag should be removed only by an especialy trained worker and inserted into another undamaged plastic bag. Leakages which are not detectable by a discharge of liquid will be detected at the point when the plastic bag is to be removed from the container, since such leakage will permit air to enter the plastic bag so that it will not closely surround and compress its contents but present a different, balloon type shape. In this case it is sufficient to insert the damaged plastic bag simply into a new bag and subject it once more to evacuation in order to turn it into an easily and safely manageable small package. In order to be able to easily determine to which degree the container is filled, it is desirable that the lid consist of a transparent plastic.

The cover and/or lid may be operable by an electric operating mechanism instead of the usual pedal mechanism. Such an arrangement not only facilitates handling but also insures that opening of the apparatus is not possible when no electric power for the operation of the suction pump is available.

In accordance with the invention it is particularly important that, during disposal of material into the container, the air above the plastic bag is sucked out. This is achieved by providing radial air suction passages in the abutment surfaces or between the abutment surface and the container cover which passages may be bores or slots whose inward extensions define a cone above the plastic bag opening and suck away any possibly contaminated air which may be disposed within such cone.

In place of separate cover sheets, there may suitably be provided a roll of plastic foil from which a foil section, after being moved over a bag opening, may be cut by means of a cutting mechanism. A mechanism for moving the plastic foil section over the bag opening may consist of engagement pins mounted on endless pull chains disposed at opposite sides of the cylinder and operable by means of an electric gear motor driving the chains through a common shaft.

In order to avoid stretching of the plastic bags disposed in the cylinder it is desirable that plastic bags with circular bottoms are used. The plastic bags may also be provided at their upper ends with radially outwardly projecting collars which facilitate heat sealing of the plastic bags. Preferably, the plastic bags consist of multilayer plastic sheets which are not only very strong but also gastight. The arrangement according to the invention is relatively small so that it can be handled easily for use at various locations. However, to facilitate handling it may be provided with casters.

Short description of the drawings, which show, by way of example, a preferred embodiment of the present invention wherein.

DESCRIPTION OF THE PREFERRED EMBODIMENT

Figure 1:
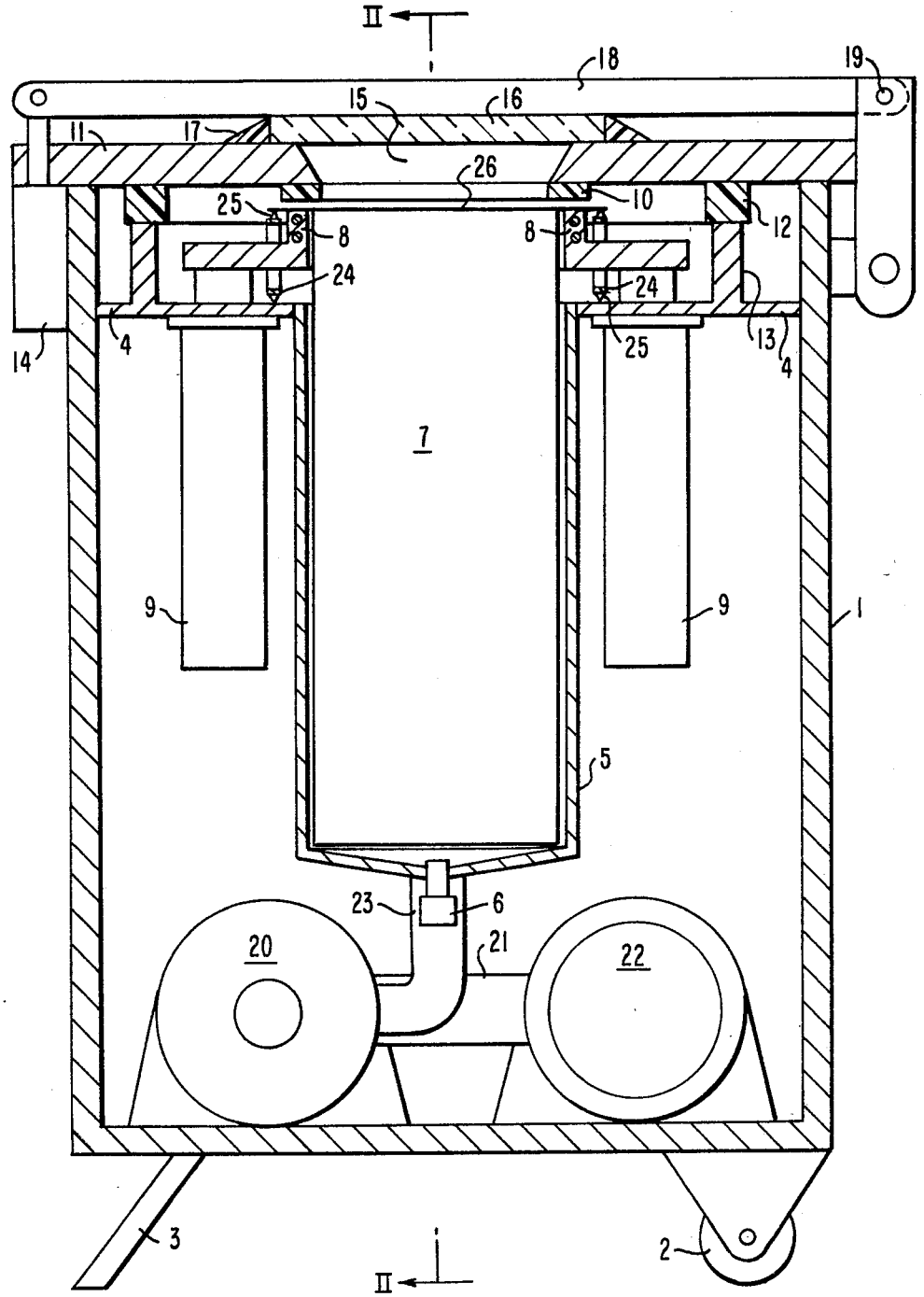
FIG. 1 shows the arrangement in longitudinal cross-section.
Figure 2:
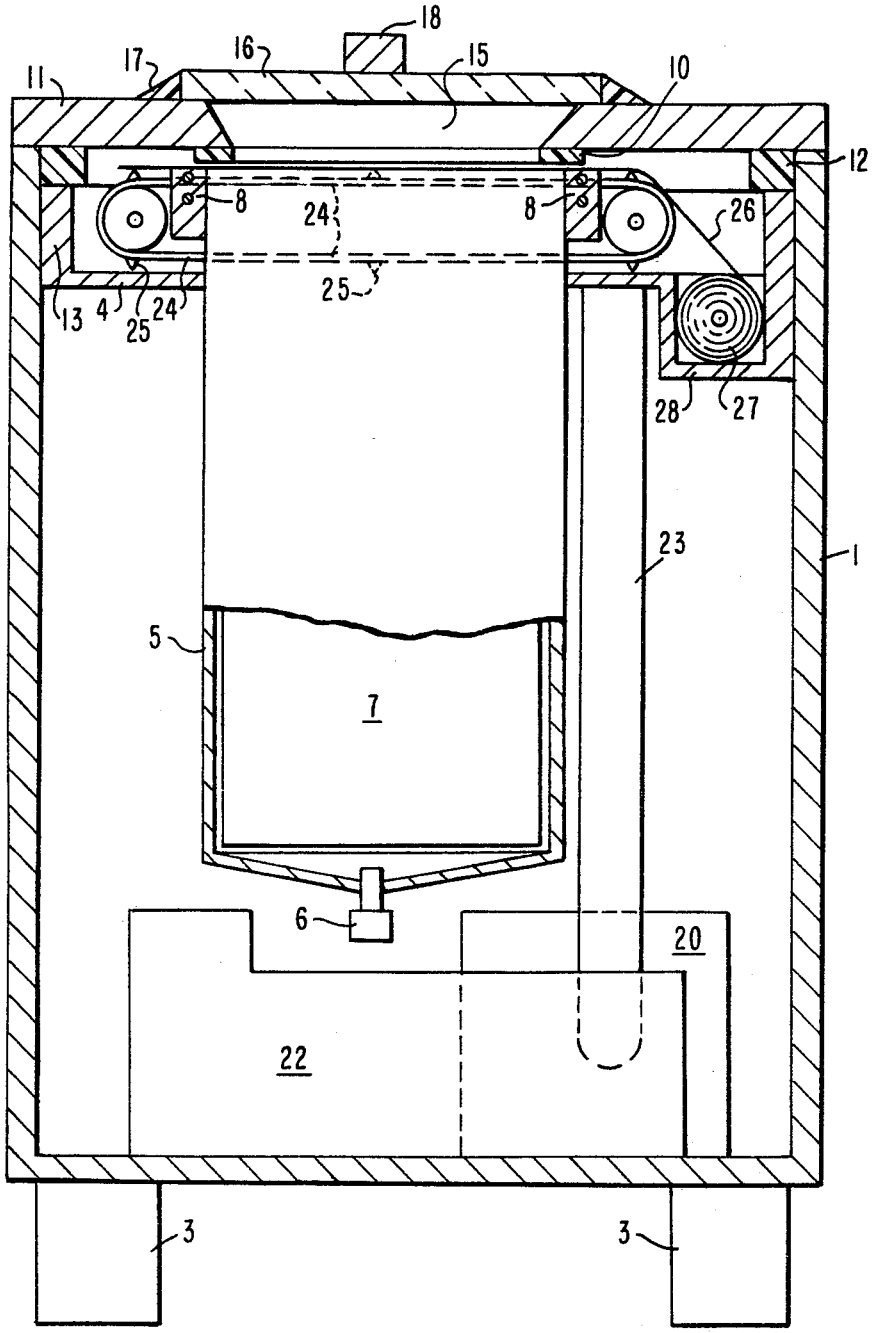
FIG. 2 is a cross-sectional view along line II—II of FIG. 1.

FIG. 1 shows a housing 1 provided at its bottom with casters 2 and legs 3 and having a top plate 4 extending thereacross at its top end which top plate 4 has a cylinder 5 mounted therein in an airtight manner. The cylinder 5 is closed at its bottom end and provided with a humidity sensor 6. Inserted into the cylinder 5 is a plastic bag 7 for the reception of contaminated or poisonous waste materials. Above the cylinder 5, the top plate 4 carries a heating ring 8 supported by operating cylinders 9 permitting the heating ring 8 to be moved up and down. Opposite the face surfaces of the heating ring 8 there is provided an abutment ring 10 with a bottom contact face of a silicon material formed on a cover 11. In addition, the cover 11 has an outer seal ring 12 which abuts a collar 13 projecting from the top plate 4. An electric locking mechanism 14 retains the cover 11 in its closed position and includes control means for the operation of the vacuum pump and the welding means. Above the cylinder 5, the cover 11 has a fill opening 15 which is normally closed by a lid 16 surrounded by a lip seal 17. The lid 16 as well as the cover 11 are supported by a pivot arm 18 linked to the container at 19. A vacuum pump 20 is arranged at the bottom of the container 1 and has a discharge in communication with an absolute filter 22 through a conduit 21. The pump 20 has its inlet disposed in communication with the space surrounded by the collar 13 between the top plate 4 and the cover 11 by means of a suction duct 23 (FIG. 2). On opposite sides of, and above, the cylinder 5 there are provided drive chains 24 provided with pins 25 and operable by an electric gear motor. The pins 25 of the drive chains 24 are in engagement with a plastic foil 26 and move the plastic foil over the opening of the cylinder 5 between the housing ring 8 and the abutment ring 10 when the drive chains are operated. The plastic foil is taken from a roll 27 placed into a trough 28 in the top plate 4.

When contaminated waste material is to be filled into the plastic bag 7 a control arrangement activates an electric operating mechanism for the lid 16 which unlocks and opens the lid 16. At the same time the vacuum pump 20 is energized and sucks air through the suction duct 23 from the space surrounded by the collar 13 and the seal ring 12 which air is replaced by air flowing inwardly through the opening 15. This safely prevents the escape of floating particles or microorganisms from the plastic bag 7 which may already be partially filled so that the operating personnel will not be contaminated. After waste material has been filled into the container, the lid 16 may be closed by moving it or the arm 18 down until the lid 16 engages the cover plate 11.

When the plastic bag 7 is filled, which may be observed through the transparent lid 16, the bag 7 must be closed and sealed. For this procedure, first the vacuum pump 20 is energized so as to evacuate—with closed lid 16—the space between the top plate 4 and the cover 11 and bounded by the collar 13 so that also the interior of the plastic bag 7 is evacuated, that is, the air pressure is reduced to about 3 torr. Then the plastic foil 26 is moved by the chains 24 across the opening 15 until the opening of the plastic bag 7 is fully covered. Subsequently, cylinders 9 are activated so that the heating ring 8 is pressed against the abutment surface 10 with an outwardly projecting collar of the plastic bag and a portion of the plastic foil 26 engaged between the heating ring 8 and the abutment surface 10. Now, the heating ring 8 is energized until the plastic bag and the plastic foil are welded together. After completion of the welding process and admission of air into the space above the top plate 4, the electric locking mechanism is energized to release the cover 11 which may then be pivoted open. During admission of air, the plastic bag and its contents are compressed by the air of atmospheric pressure rushing into the cylinder 5 such that the plastic bag shrinks in size to only about 20% of its previous volume. The plastic bag may therefore easily be taken out of the cylinder 5 and replaced by a new plastic bag 7. After closing of the cover 11 (and lid 16) the apparatus according to the invention is again ready for use.

We claim:

1. Apparatus for packaging contaminated or poisonous waste materials, said apparatus comprising a container having bottom and side walls, a top plate extending across said container at its top end, a cylinder sealingly mounted on said top plate and extending downwardly into said container, said cylinder being closed at its bottom and adapted to receive a plastic bag with an outwardly projecting top rim, a cover pivotally supported on said container so as to seal said container when said cover is closed, said cover being spaced from said top plate and having an opening in alignment with said cylinder, a lid pivotally disposed on top of said cover so as to seal said cover opening when in its closed position, a vacuum pump disposed in said container and having an inlet and an outlet, a suction duct connected between said inlet and a suction space between said top and cover plates so as to permit removal of air from said suction space, an absolute filter also disposed in said container, said pump having its outlet in communication with said absolute filter so as to supply its discharge air to said filter, said top plate having a trough formed therein for the reception of cover foil, means for moving said cover foil within the suction space over the opening of said plastic bag, a heating ring axially movably disposed at the top of said cylinder, said cover plate having an abutment surface area disposed opposite said heating ring, means for axially moving said heating ring toward said cover against said abutment surface with the rim of a plastic bag disposed in said cylinder and said cover foil engaged therebetween, and electric control means for operating said vacuum pump upon opening of said lid to remove air from said suction space thereby preventing the escape of poisonous material from said container when said lid is opened and for the control of the vacuum pump and energization of said heating ring during heat welding operation of said cover foil onto said plastic bag when said lid is closed, said vaccum pump being adapted to evacuate said suction space and, together therewith, said cylinder so as to perform said heat welding operation of said cover foil onto said plastic bag under vacuum whereby, upon subsequent admission of ambient air to said suction space and said cylinder, said sealed plastic bag with the waste material contained therein is compressed and maintained compressed by the ambient air.

2. Apparatus as claimed in claim 1, wherein a humidity sensor is disposed at the bottom of said cylinder.

3. Apparatus as claimed in claim 1, wherein the lid consists of transparent plastic provided with a circumferential lip seal.

4. Apparatus as claimed in claim 1, wherein said cover and said lid are lockable and releasable by an electrically operable lock.

5. Apparatus as claimed in claim 1, wherein said cover foil is provided by a foil roll disposed in said trough, said foil being cut from said roll after being pulled over said plastic bag.

6. Apparatus as claimed in claim 1, wherein said means for moving the cover foil over said plastic bag opening consists of two drive chains arranged at opposite sides of said cylinder and having pins projecting therefrom and engaging said foil.

7. Apparatus according to claim 1, wherein said plastic bag is provided with a circular bottom section.

8. Apparatus as claimed in claim 1, wherein said plastic bag has a radially outwardly projecting weld collar at its top end.

9. Apparatus as claimed in claim 1, wherein said plastic bag consists of a multilayer plastic material.

10. Apparatus as claimed in claim 1, wherein said container is provided with casters.

* * * * *